US005253790A

United States Patent [19]

Brady

[11] Patent Number: 5,253,790

[45] Date of Patent: Oct. 19, 1993

[54] FABRIC CUTTING SYSTEM

[76] Inventor: John R. Brady, 20041 Canada Rd., #R4, El Toro, Calif. 92630

[21] Appl. No.: 479

[22] Filed: Jan. 5, 1993

Related U.S. Application Data

[63] Continuation-in-part of Ser. No. 899,344, Jun. 16, 1992, abandoned.

[51] Int. Cl.[5] ..... A47B 25/00

[52] U.S. Cl. ..... 223/109 R; 206/574; 211/59.1

[58] Field of Search ..... 206/225, 223, 493, 574, 206/575; 211/59.1; 223/1, 106, 108, 109 R

[56] References Cited

U.S. PATENT DOCUMENTS

| | | | |
|---|---|---|---|
| 444,328 | 1/1891 | Boss | 206/303 |
| 1,225,952 | 5/1917 | Hamilton | 211/59.1 |
| 1,277,211 | 8/1918 | Graham | 211/59.1 |
| 2,284,518 | 2/1941 | Green | 211/59.1 |
| 2,814,274 | 11/1957 | Diamond | 120/82 |
| 2,814,275 | 11/1957 | Diamond | 120/82 |
| 3,788,487 | 1/1974 | Dawson | 211/59.1 |
| 3,813,727 | 6/1974 | Borer, Jr. et al. | 16/1 |
| 3,818,727 | 6/1974 | Hadam et al. | 66/127 |

FOREIGN PATENT DOCUMENTS

| | | | |
|---|---|---|---|
| 0595357 | 1/1925 | France | 211/59.1 |

*Primary Examiner*—Jimmy G. Foster

*Attorney, Agent, or Firm*—Stetina and Brunda

[57] ABSTRACT

A system for holding a pattern and a material or fabric to be cut in place upon a mat has at least one holding means or pin weight for maintaining the positioning of the pattern relative to the material to be cut and a storage means facilitating the stacking of a plurality of the pin weights. The pin weights comprise a body, attachment means formed upon the body for attaching the body to the mat, and registration means formed upon the body to facilitate stacking of a plurality of such pin weights. The storage means comprises a plurality of posts, each post being of a different diameter to facilitate stacking of a plurality of pin weights having different sized central openings formed therethrough. Each pin weight preferably comprises a generally circular body, having a generally circular central opening formed therethrough and a plurality of pins extending downwardly therefrom. The caddy also has a holder for receiving and conveniently storing a cutter. The cutter is stored such that its handle is conveniently graspable to remove the cutter from the holder. The holder preferably orients the cutter handle at an angle of approximately forty-five degrees to the horizontal. The caddy has a base upon which the posts and holder are attachable such that the posts and holder may be removed therefrom to facilitate substantially flat packing of the caddy for storage and transportation.

13 Claims, 2 Drawing Sheets

FABRIC CUTTING SYSTEM

RELATED APPLICATIONS

This application is a continuation in part application of copending U.S. Ser. No. 07/899,344, filed on Jun. 16, 1992 and entitled "FABRIC CUTTING SYSTEM", now abandoned, the contents of which are incorporated by reference.

FIELD OF THE INVENTION

The present invention relates generally to sewing and more particularly to a system for holding a pattern and material to be cut in place upon a mat such that the pattern does not move relative to the material to be cut during the cutting process.

BACKGROUND OF THE INVENTION

It is often desired to cut material to be used in the fabrication of clothing, quilts, and various other fabric articles. This is typically accomplished by pinning a pattern which defines the desired shape of the material to the material itself and using scissors to cut the material in the shape defined by the pattern. To pin the pattern to the material to be cut, the pattern is placed in laminar juxtaposition therewith and a plurality of folds are formed in the pattern and the material to be cut such that pins may be inserted therethrough. That is, at each location where pinning is desired, a fold is made and a pin is pushed through the pattern and the material to be cut at the site of the fold.

Due to this folding of the pattern and the material to be cut, wrinkles are often formed in the material. Furthermore, such folding and pinning inherently reduces the accuracy with which cutting can be accomplished as well as necessarily expends an inordinant amount of user time. As such, it is highly desirable to provide a means for cutting fabric which does not involve folding of the pattern and material to be cut.

Rotary razor cutters for cutting material to be used in the fabrication of clothing, quilts, and various other fabric articles, are well known. Such rotary razor cutters generally comprise a cutting wheel pivotally attached to a handle such that the cutting wheel rotates when pressed against a fabric and moved thereover. As the cutting wheel rotates, the fabric captured therebeneath is cut.

Typically, the fabric to be cut is first placed upon a mat which both facilitates the attachment of a pattern to the fabric to be cut and provides a protective surface for the table top upon which it is usually positioned. A pattern, which defines the shape to which the material is to be cut, is generally attached to the material via weights having sharp pins extending from the lower surface thereof, i.e., pin weights. A plurality of such pin weights are generally positioned at intervals about the pattern along the cut to be made such that the pins extend downwardly through the pattern, through the material to be cut. Thus, the pins of the pin weights prevent relative movement of the pattern and material to be cut, thereby preventing shifting during the cutting process.

The mat thus provides a convenient surface upon which such cuts may be made by providing a somewhat durable and resilient surface which is not damaged by the razor wheel of the cutter, which does not tend to rapidly dull the cutting surface of the cutter, and which protects the surface upon which the mat is placed, e.g. a tabletop or counter surface.

As such, one typically positions the material to be cut upon the upper surface of the mat, positions the pattern defining the cut to be made upon the material in a desired manner, and then positions a plurality of pin weights or holders about the periphery of the pattern along the cut to be made. The razor wheel of the cutter is then pressed firmly down through the pattern and the material to be cut as the cutter is manually urged along the cut to be made defined by the pattern As the cutter is moved along the pattern, the razor wheel rotates, thus cutting through the pattern and material to be cut. The pointed pins of the pin weights extend downwardly through the pattern and the material to be cut, thus securing them firmly in position and preventing any relative motion therebetween. The pin weights may be easily removed and/or repositioned as desired.

Although generally suitable for its intended purpose, the prior art cutting system suffers from inherent deficiencies which detract from its effectiveness and convenience. The pin weights which are utilized to maintain the relative positioning of the pattern and material to be cut commonly present a problem when they are not being utilized in the cutting process. The sharp pins extending downwardly therefrom make it undesirable to lay the weights upon finished surfaces, such as those of wood furniture, since they would therefore cause scratching or damage thereto. However, it is likewise undesirable to lay the pin weights down with the pins extending upwardly therefrom since this creates a potential for injury. The upwardly extending pins can injure anyone accidently coming into contact therewith, e.g. resting a hand or arm thereupon. No simple and convenient means is known for properly and safely storing such pin weights. It would thus be desirable to provide a means for holding such pin weights in a manner which does not present a hazard to property and/or people.

SUMMARY OF THE INVENTION

The present invention specifically addresses and alleviates the above mentioned deficiencies associated in the prior art. More particularly, the present invention comprises a system for holding a pattern and a material or fabric to be cut in place upon a mat and has at least one holding means or pin weight for maintaining the positioning of the pattern relative to the material to be cut and a storage means or caddy facilitating the stacking of a plurality of the holding means or pin weights. The pin weights comprise a body, attachment means formed upon the body for attaching the body to the mat, and registration means formed upon the body to facilitate stacking of a plurality of the pin weights.

The registration means of the storage means or caddy comprises at least one, preferably a plurality, of posts, each post being of a different diameter to facilitate stacking of a plurality of pin weights having different sized central openings formed therethrough.

Each holding means or pin weight preferably comprises a generally circular body, having a generally circular central opening formed therethrough and a plurality of pins extending downwardly therefrom. The opening defines a complimentary registration means which facilitates stacking of a plurality of pin weights about the post.

Optionally, each pin weight may further comprise an upwardly extending standoff such that the attachment means, preferably pins extending downwardly from a pin weight stacked above, does not contact the lower pin weight, thus preventing marring of the upper surface of the lower pin weight and also preventing damage to the pointed ends of the pins. Those skilled in the art will recognize that various other configurations of standoffs are likewise suitable. Indeed, various configurations of posts, partitions, extensions, bosses, etc. may be formed upon the upper surface of the pin weights to function as standoffs.

The storage means or caddy preferably has two such posts, each post being of a different diameter for stacking pin weights of two different sizes. The caddy preferably has standoff means formed thereon such that the pins of the lowermost weight do not contact and/or damage the caddy. Subsequently stacked weights rest upon those weights disposed immediately below.

The storage means or caddy also has a holder for receiving and conveniently storing a cutter. The cutter is stored such that its handle is conveniently graspable to facilitate removal of the cutter from the holder. The holder preferably orients the cutter handle at an angle of approximately forty-five degrees to the horizontal. In the preferred embodiment, but not by way of limitation, the caddy has a base upon which the posts and holder are attachable such that the posts and holder may remain removed therefrom to facilitate substantially flat packing of the caddy for storage and transportation.

Thus, the caddy or storage means provides a means for conveniently and safely storing the pin weights or holding means wherein the sharp tips of the pins do not present a hazard to either the user or the user's property. With the pin weights stacked about the posts of the caddy having their pins downward such that the sharp tips of the pins are not exposed, they do not present a hazard. The sharp pins of the bottommost holding means or weight are held above or harmlessly contact the upper surface of the caddy. The sharp pins of higher or subsequently stacked holding means or pin weights harmlessly contact the upper surface of those holding means positioned therebelow. The cutter is maintained at a convenient location and orientation such that it may be rapidly and safely grasped and immediately used for its intended cutting function, then conveniently restored to its storage position. As such, the fabric cutting system of the present invention provides a means for enhancing safety, as well as improving speed and productivity of the sewing process.

These, as well as other advantages of the present invention will be more apparent from the following description and drawings. It is understood that changes in the specific structure shown and described may be made within the scope of the claims without departing from the spirit of the invention.

DETAILED DESCRIPTION OF THE PREFERRED EMBODIMENT

The detailed description set forth below in connection with the appended drawings is intended as a description of the presently preferred embodiment of the invention and is not intended to represent the only form in which the present invention may be constructed or utilized. The description sets forth the functions and sequence of steps for constructing and operating the invention in connection with the illustrated embodiment. It is to be understood, however, that the same or equivalent functions and sequences may be accomplished by different embodiments that are also intended to be encompassed within the spirit and scope of the invention.

Figure 1:
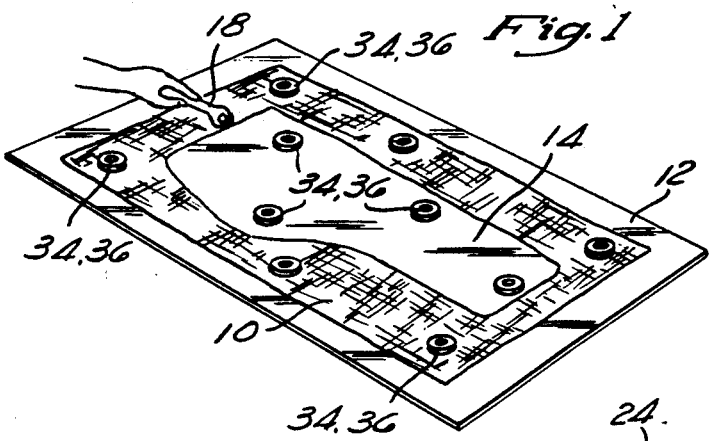
FIG. 1 is a perspective view of the fabric cutting process according to the present invention.

The fabric cutting system of the present invention is illustrated in FIGS. 1–6 which depict a presently preferred embodiment of the invention. Referring now to FIG. 1, the cutting of a material or fabric 10, is performed by first disposing the material 10 upon a mat 12. The mat 12 is formed of a durable and resilient material, such as hard polymer or rubber. Next, the pattern 14 is positioned as desired upon the material 10 to be cut and held in place with holding means or pin weights 34,36. A plurality of such pin weights 34,36 may be distributed directly upon the interior of the pattern or about the periphery of the pattern sheet 14 such that the pattern 14 and material 10 are held securely in position upon the mat 12. Such pin weights 34,36 comprise a weighted or metallic material having a plurality of pins 42 (FIG. 5) extending from the lower surface thereof such that when placed upon the pattern 14, the pins 42 extend downwardly therethrough to securely maintain the pattern 14 and material 10 together upon the mat 12. It should be noted however that the pins 42 do not extend into the mat itself, but rather reside upon the top surface of the mat. As such, the pattern 14 and fabric material 10 may be moved in unison upon the mat as desired with the pin weights thereon.

Pin weights 34 are preferably of a different size and weight from pin weights 36 such that the user is provided with some flexibility in the choice of pin weights. Thus, pin weights 34 may optionally have a different inner diameter from pin weights 36 to facilitate segregation thereof. Thus, pin weights of a given size and weight may be stacked upon a particular post 24 or 26.

After the material 10 and the pattern 14 are secured in position with the pin weights 34 or 36, a razor knife or rotary cutter 18 (best shown in FIG. 3) is urged about the pattern along the line of the desired cut in the material 10. The rotary cutter 18 thus cuts the material 10 in the manner defined by the pattern 14. Alternatively, those skilled in the art will recognize that the plural weights 34,36 may be used initially in an analogous manner to hold the pattern 14 upon the mat 12 to enable the pattern 14 to be cut prior to initial placement upon the fabric.

Once the cutting process is completed, the user is confronted with the problem of safely and conveniently storing the pin weights 34 and 36. The pin weights cannot be placed with the pins 42 oriented downward upon finished surfaces such as those of furniture or countertops without incurring potential damage thereto. The pin weights 34 and 36 furthermore should not be placed with the pins uppermost due to the possibility of inflicting injury upon anyone inadvertently coming into contact therewith. As such, the pin weights 34 and 36 must generally be stored within a container, i.e. a box or drawer, thus necessitating that such a container be available and utilized properly As can be appreciated, there is a general tendency to forsake use of a proper container in the interest of convenience. This commonly results in damaged property and/or injury to people.

Figure 2:
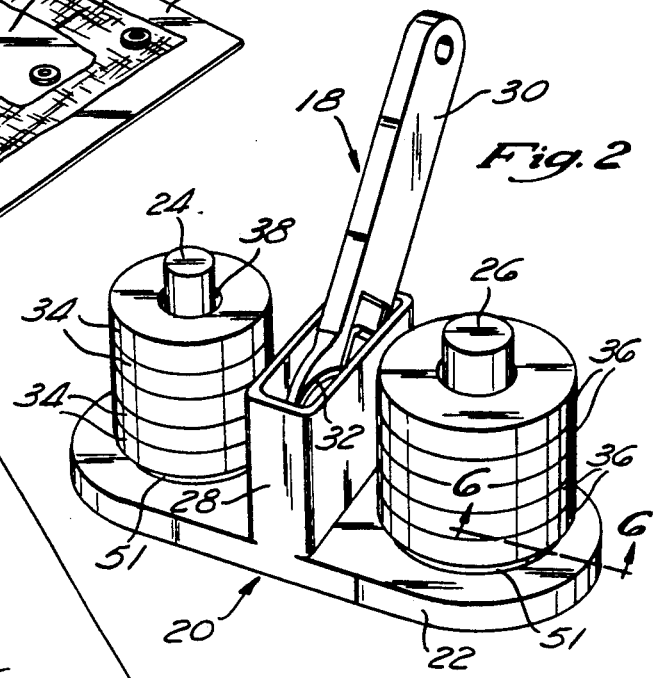
FIG. 2 is a perspective view of the fabric cutting system of the present invention illustrating a plurality of holding means or pin weights disposed upon the posts of the caddy thereof and having a rotary cutter disposed within the holder thereof.
Figure 3:
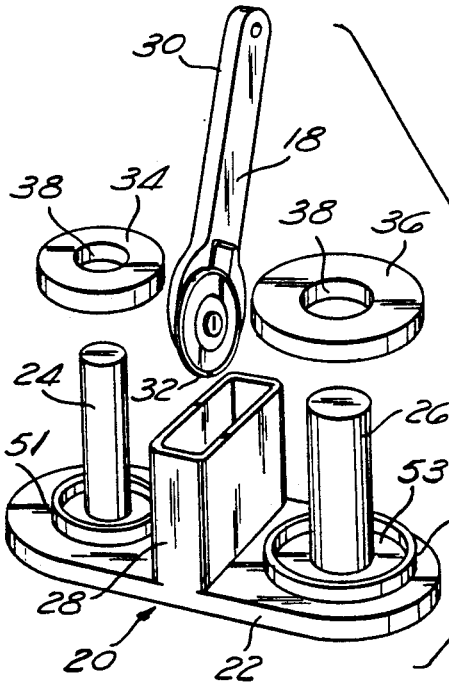
FIG. 3 is a perspective view of the fabric cutting system of FIG. 2 depicting the caddy with the pin weights removed from the posts thereof and the cutter removed from the holder thereof.

Referring now to FIGS. 2 and 3, the fabric cutting system of the present invention further comprises a caddy 20 having a base 22 and a plurality, preferably two, of posts 24 and 26, extending upwardly from the base 22. Disposed upon the base 22, preferably intermediate the posts 24 and 26, is a holder 28, defined by a generally rectangular, open topped hollow structure, into which the rotary cutter 18 is disposable such that the handle 30 of the rotary cutter 18 extends from the holder 28 when the rotary blade 32 thereof is positioned therein. The handle 30 is preferably oriented at an angle of approximately forty-five degrees to the horizontal when the rotary cutter 18 is disposed within the holder 28.

With particular reference to FIG. 2, a plurality of holding means or pin weights 34 and 36 are disposed upon the posts 24 and 26, respectively. The pin weights 34 disposed upon post 24 are preferably of a different size than the pin weights 36 disposed upon the post 26 such that a choice of configurations, i.e. weights and sizes, is provided.

Figure 4:
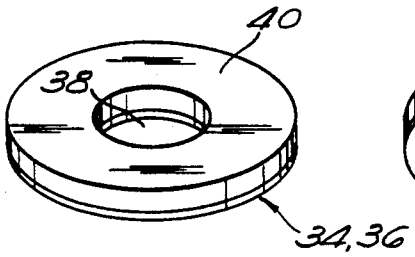
FIG. 4 is an enlarged view of the upper surface of a holding means or pin weight of FIG. 2.
Figure 5:
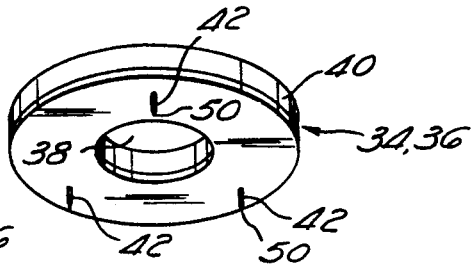
FIG. 5 is an enlarged perspective view of the holding means or pin weight of FIG. 2 showing the lower surface having the pointed pins extending therefrom.

Each pin weight 34 and 36 is generally circular in configuration and has a generally circular central opening 38 (as best seen in FIGS. 4 and 5) formed therein. The posts 24 and 26 are preferably of different diameters, which conform generally to the different diameters of the central apertures 38 formed within the pin weights 34 and 36 disposed thereupon. The use of such posts 24 and 26 having different diameters to accommodate the different diameters of the central apertures 38 of the pin weights 34 and 36 thus facilitates segregation of the pin weights 34 and 36 by size such that when removing pin weights from a particular post 24 or 26, the user obtains pin weights of a desired size. Those skilled in the art will recognized that various numbers of posts 24 and 26 may be utilized to provide for the storage of a like number of sizes and weights of pin weights. Referring now to FIGS. 4 and 5, each pin weight 34 or 36 generally comprises a circular body 40 having an aperture 38 formed therein. The body is preferably formed of metal, such as steel, which is preferably covered with a polymer or plastic material. However, other suitable material candidates comprise lead, ceramic, silica, or heavy polymers. A plurality of attachment means or sharp pins 42, preferably three, extend downwardly from the body 40.

Figure 6:
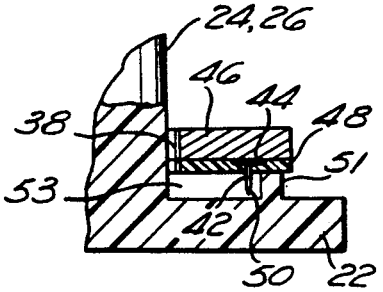
FIG. 6 is an enlarged cross-sectional view of the holding means or pin weight of FIGS. 4 and 5 illustrating the functioning of the standoff to keep the pins thereof from contacting the base of the storage means or caddy.

Referring now to FIG. 6, the pin weights 34 and 36 are preferably formed by disposing a steel washer 46 within a plastic cover 48 such that the head 44 of a thumb tack 50 is captured between the steel washer 46 and plastic cover 48 and the shaft of pin 42 extends through the plastic cover 48 downwardly.

Standoffs 51 preferably position the lowermost pin weight 34 or 36 such that the points 50 of the pins 42 do not contact the base 22. The standoffs 51 are preferably configured as annular members disposed about the posts 24 and 26 and are formed upon the base 22. The pins 42 of the lowermost pin weights 34 and/or 36 are thus disposed within the voids 53 defined by the standoffs 51.

Figure 7:
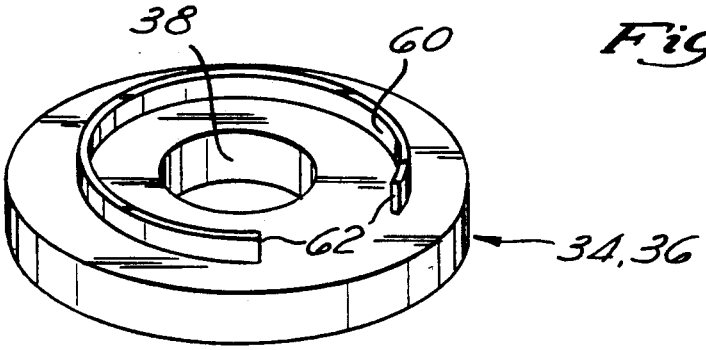
FIG. 7 is an enlarged perspective view of a holding means or pin weight having a standoff formed upon the upper surface thereof.
Figure 8:
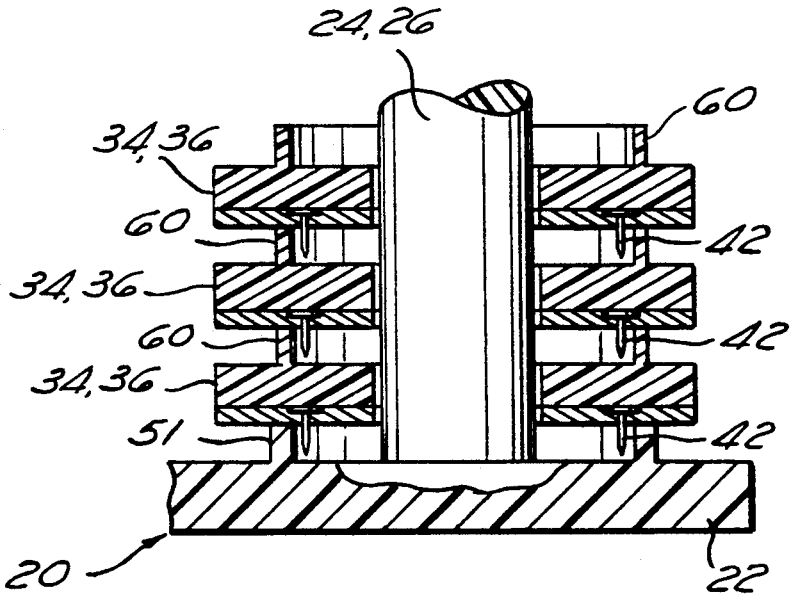
FIG. 8 is a cross-sectional side view of a plurality of holding means or pin weights stacked one atop another utilizing the storage means or caddy of FIG. 3.

Referring now to FIG. 7, the pin weights 34 or 36 may optionally further comprise a standoff 60 formed upon the upper surface thereof and extending upward a sufficient distance such that the pins 42 of a pin weight stacked thereupon do not contact the upper surface of the lower pin weights 34, 36. The standoff 60 is preferably configured as an annular member formed about the central aperture 38. The annular member need not be continuous, but rather may comprise one or more discontinuities or openings 62. Indeed, those skilled in the art will recognize that various other configurations, i.e. posts, bosses, etc., are likewise suitable for the use of standoffs. Referring now to FIG. 8, a plurality of pin weights 34 or 36 are stacked one atop another on a caddy 20. The standoff 51 formed upon the base 22 of the caddy 20 prevents the pins 42 of the lower-most pin weight 34 or 36 from contacting the caddy 20. Similarly, the standoffs 60 formed upon the upper surfaces of the lower two pin weights 34 or 36 prevent the pins 42 of the pins weights 34 or 36 stacked thereupon from contacting their upper surfaces.

Thus, the use of such standoffs 60 prevent the pointed tips of the pins 42 of pin weights 34 or 36 stacked on top one another from marring or otherwise damaging the surfaces of those pin weights 34 or 36 positioned therebelow. By preventing contact of the pointed tips of the pins 42 with the upper surfaces of those pin weights 34 or 36 positioned therebelow, the sharpness of the tips is maintained. That is, the tips of the pins 42 are not dulled by repeated contact with the upper surfaces of the pin weights 34 or 36 positioned therebeneath.

Having described the structure of the fabric cutting system of the present invention, a description of the use thereof might be beneficial. The pin weights 34 and 36 are generally stored upon the posts 24 and 26 of the caddy 20. The caddy 20 is disposed near the mat 12 (FIG. 1) such that the pin weights 34 and 36 may conveniently be removed from the caddy 20 and positioned as desired upon the pattern 14 to secure the pattern 14 and material 10 to be cut in position upon the mat 12.

Upon the completion of the cutting process, the pin weights 34 and 36 are returned to their proper positions upon the posts 24 and 26 of the caddy 20. Thus, the sharp tips 50 of all of the pin weights 34 and 36 are disposed in a safe manner wherein they cannot come into contact with property or people and thereby cause injury thereto.

The apertures 38 of the pin weights 34 and 36 and the posts 24 and 26 of the caddy 20 thus cooperate to define registration means to maintain positioning of the pin weights 34 and 36 upon the posts 24 and 26, respectively. By positioning the pin weights 34 and 36 in alignment upon the posts 24 and 26, individual pin weights may be conveniently grasped and removed therefrom with minimal potential for injury from the pins 42 thereof.

It is understood that the exemplary fabric cutting system described herein and shown in the drawings represents only a presently preferred embodiment of the invention. Indeed, various modifications and additions may be made to such embodiment without departing from the spirit and scope of the invention. For example, the pin weight bodies 40 need not be generally circular as described and illustrated, but rather may be of any convenient shape. Likewise, the apertures or central openings 38 formed through the pin weight bodies 40 need not be generally circular as described and illustrated, but rather may be of any shape which corresponds generally to the cross-section of the posts 24 and 26 such that the pin weights 34 and 36 may be conveniently stacked thereon. Thus, these and other modifications and additions may be obvious to those skilled in the art and may be implemented to adapt the present invention for use in a variety of different applications.

What is claimed is:

1. A system for holding a pattern and a material to be cut in place upon a mat, said system comprising:

a) a plurality of first generally circular bodies having a generally circular central aperture formed therein of a first diameter and having pins extending downwardly therefrom;

b) a plurality of second generally circular bodies having a generally circular central aperture formed therein of a second diameter and having pins extending downwardly therefrom; and c) a caddy having a base and a holder, first posts of a first diameter extending upwardly from said base, the first diameter of said first post being less than the first diameter of said first bodies to facilitate stacking of said first bodies about said first post, and second posts of a second diameter extending upwardly from said base, second diameter of said second post being less than the second diameter of said second bodies to facilitate stacking of said second bodies about said second post.

2. The system as recited in claim 1 wherein said caddy further comprises first standoff means formed upon the base thereof such that the pins of first and second generally circular bodies disposed thereupon are prevented from contacting the base.

3. The system as recited in claim 1 wherein said first and second generally circular bodies further comprise second standoff means formed upon the upper surface thereof such that the pins of first and second generally circular bodies disposed thereupon are prevented from contacting first and second generally circular bodies therebelow.

4. A system for holding a pattern and a material to be cut in place upon a mat, said system comprising:

a) a plurality of generally circular bodies having a generally circular central aperture formed therein and having a plurality of pins extending downwardly therefrom; and b) a caddy having a base and a holder and also having at least one post extending upwardly from said base, the diameter of said post being less than the diameter of said central aperture in said bodies to facilitate stacking of said bodies about said post.

5. The system as recited in claim 4 wherein said caddy further comprises first standoff means formed upon the base thereof such that the pins of first and second generally circular bodies disposed thereupon are prevented from contacting the base.

6. The system as recited in claim 4 wherein said first and second generally circular bodies further comprise second standoff means formed upon the upper surface thereof such that the pins of first and second generally circular bodies disposed thereupon are prevented from contacting first and second generally circular bodies therebelow.

7. The system as recited in claim 4 wherein said plurality of pins comprises three pins spaced approximately equal distance from one another.

8. The system as recited in claim 4 wherein said plurality of pins comprise thumbtacks attached to said body such that the points thereof extend downwardly from said body.

9. The system as recited in claim 4 wherein said body comprises a steel washer.

10. The system as recited in claim 4 wherein said plurality of generally circular bodies comprise:

a) a plurality of first generally circular bodies having a generally circular central aperture formed therein of a first diameter, and a plurality of second generally circular bodies having a generally circular central aperture formed therein of a second diameter; and b) said caddy comprises a first post of a first diameter, the first diameter of said first post being less than the first diameter of said first bodies, said caddy also comprising a second post of a second diameter, the second diameter of the central aperture of said second post being less than the second diameter of said second bodies

11. The system as recited in claim 4 further comprising a holder for receiving and storing a cutter, the cutter having a handle.

12. The system as recited in claim 11 wherein said holder orients the cutter such that the handle thereof is conveniently graspable to remove the cutter from said holder.

13. The system as recited in claim 12 wherein said holder orients the cutter handle at an angle of approximately 45 degrees to the horizontal.

* * * * *